US006326135B1

(12) United States Patent
Droin et al.

(10) Patent No.: US 6,326,135 B1
(45) Date of Patent: Dec. 4, 2001

(54) PRODUCT FOR INDUSTRIAL RADIOGRAPHY

(75) Inventors: Gerard M. Droin, Beaune; Jacques Roussilhe, Virey le Grand, both of (FR)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/304,717

(22) Filed: May 4, 1999

(30) Foreign Application Priority Data

May 27, 1998 (FR) ..... 98 06867

(51) Int. Cl.[7] ..... G03C 1/005; G03C 5/16

(52) U.S. Cl. ..... 430/600; 430/607; 430/567; 430/569; 430/966; 430/967

(58) Field of Search ..... 430/567, 139, 430/600, 966, 967, 607

(56) References Cited

U.S. PATENT DOCUMENTS

| | | | | |
|---|---|---|---|---|
| 3,667,958 | * | 6/1972 | Evans et al. | 430/350 |
| 4,040,833 | * | 8/1977 | Hinata et al. | 430/583 |
| 5,763,145 | * | 6/1998 | Ling | 430/375 |
| 5,773,208 | * | 6/1998 | Hau et al. | 430/607 |
| 5,876,905 | * | 3/1999 | Irving et al. | 430/350 |
| 5,965,337 | * | 10/1999 | Droin et al. | 430/440 |

FOREIGN PATENT DOCUMENTS 0 757 286 A1 2/1997 (EP) .

1 320 797 6/1973 (GB) .

* cited by examiner

*Primary Examiner*—Janet Baxter
*Assistant Examiner*—Amanda C. Walke

(57) ABSTRACT

This invention concerns a non-spectral sensitized radiographic product for exposure to ionizing radiation of energy equal to at least 40 keV containing at least 50 mg/dm$^2$, which comprises a support covered with on at least one of its sides with a layer of silver halide emulsion in which at least 50% of the grains are tabular grains, and at least 0.05 mmol/mol Ag of a compound of formula (I)

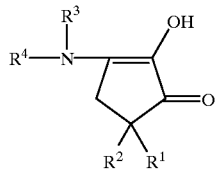

wherein $R^1$ and $R^2$ are each independently an atom of hydrogen, an alkyl group comprising from 1 to 5 atoms of carbon, substituted or not, a hydroxyl group, or a benzyl group; $R^3$ and $R^4$ are each independently a hydrogen, or an alkyl group from 1 to 5 atoms of carbon, or jointly comprise the atoms necessary to form a heterocycle of 4 to 6 atoms, substituted or not.

The product for industrial radiography of the invention provides an improved keeping of the latent image and higher speed.

6 Claims, No Drawings

PRODUCT FOR INDUSTRIAL RADIOGRAPHY

FIELD OF THE INVENTION

The present invention relates to a silver halide radiographic product designed for exposure to high energy ionizing radiation, a new industrial radiographic system, and a method for obtaining an industrial radiographic image. More particularly, it relates to a product for high energy industrial radiography with improved latent image keeping and higher speed.

BACKGROUND

Industrial radiography is a non-destructive method for the inspection and analysis of defects in items made of, for example, glass, paper, wood or metal. This method is widely used in the aeronautical, nuclear and petroleum industries for the detection of defects in welds and texture of materials in aircraft and nuclear reactor parts and in pipe lines.

This method involves exposing a radiographic product containing a silver halide emulsion to high energy ionizing radiation, generally X or γ rays. The sensitivity of the radiographic emulsions to X and γ rays is due to the absorption of part of these rays by the silver halide grains, causing a secondary emission of electrons, and thereby forming an internal latent image. The radiographic product is then developed and fixed.

Unlike medical radiographic films, which are exposed through luminescent screens that re-emit visible light, films for industrial radiography do not need to be sensitive to visible light, and so are generally not color-sensitive. Films for industrial radiography are either exposed directly to ionizing radiation, or exposed through a screen that intensifies the ionizing radiation. These intensifying screens, generally made of metal, increase the proportion of the ionizing radiation that can be absorbed by the silver halide grains.

Products for industrial radiography generally use a silver halide emulsion made mostly of thick grains (cubic or other solid shape) to absorb as much of the ionizing radiation crossing the emulsion layer as possible.

Also known are films for industrial radiography comprising emulsions made of specific tabular grains such as those described, for example, in U.S. Pat. No. 4,883,748 or Patent Application EP 757,286. When a radiographic product comprising tabular grain emulsions is exposed to ionizing radiations the keeping of the latent image is impaired.

SUMMARY OF THE INVENTION

The object of this invention is to provide a new product for industrial radiography in which the keeping of the latent image obtained by exposure to ionizing radiation is improved. Another object of this invention is to provide a radiographic product of improved radiographic sensitivity.

These and other objects are achieved by this invention, which concerns a non-color-sensitive radiographic product designed for exposure to ionizing radiation of energy equal to at least 40 keV containing at least 50 mg/dm$^2$ of silver, which comprises a support coated on at least one of its sides with a layer of silver halide emulsion in which at least 50% of the grains are tabular grains, and at least 0.05 mmol/mol Ag of a compound of formula (I)

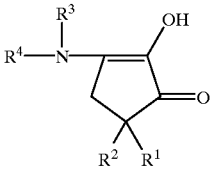

wherein $R^1$ and $R^2$ each independently represent an atom of hydrogen, an alkyl group comprising from 1 to 5 atoms of carbon, substituted or not, a hydroxyl group, or a benzyl group, and $R^3$ and $R^4$ each independently represent a hydrogen, or alkyl group comprising from 1 to 5 atoms of carbon, or jointly represent the atoms necessary to form a heterocycle of 4 to 6 atoms, substituted or not.

The present invention further concerns a method of formation of an image in an industrial radiography product that involves the exposure of the photographic product to ionizing radiation of energy equal to at least 40 keV to form a latent image, and the subsequent development of the product to form a radiographic image.

DESCRIPTION OF PREFERRED EMBODIMENTS

In an embodiment of the invention, the radiographic product is exposed to radiation in the energy range 40 keV to 20 MeV.

In particular, this new radiographic product unexpectedly shows an improved keeping of the latent image obtained on exposure to ionizing radiation. The product of the invention also shows higher speed on exposure to ionizing radiation of energy greater than or equal to 400 keV.

One or more compounds (I) can be incorporated into the radiographic product of this invention.

Preferably, the quantity of compound (I) incorporated ranges from 0.1 mmol/mol of silver to 0.5 mmol/mol of silver.

In the scope of the invention, $R^1$ and $R^2$ can be independently straight-chain or branched-chain alkyl groups. $R^1$ and $R^2$ can be methyl, ethyl, propyl, butyl or pentyl groups, preferably methyl. In a specific embodiment, $R^1$ is a hydrogen atom or a hydroxyl group, and $R^2$ is an alkyl group, preferably methyl.

$R^3$ and $R^4$ can be independently straight-chain or branched-chain alkyl groups. $R^3$ and $R^4$ can each independently be, for example, a methyl, ethyl, propyl, butyl or pentyl group. When $R^3$ and $R^4$ jointly comprise the atoms necessary to form a heterocycle, that heterocycle can contain a further atom of nitrogen and (or) oxygen. The heterocycle thus obtained can comprise 5 to 6 members, forming, for example, a morpholino, pyrrolidino, piperidino, or piperazino group etc.

Useful compounds (I) in the present invention are, for example:

(A)

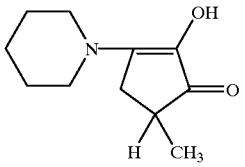

(B)

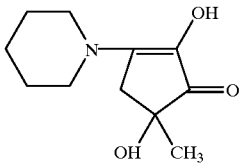

(C)

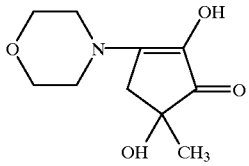

(D)

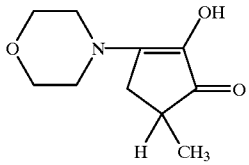

(E)

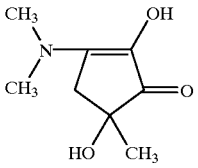

(F)

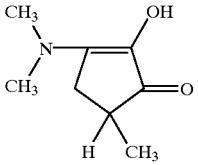

In the invention, the radiographic product comprises a quantity of silver in the range 50 to 200 mg/dm$^2$.

The radiographic product of the invention comprises at least one tabular grain emulsion. "Tabular grains" are defined as grains possessing two parallel sides of greater surface area than the other sides of the grain. These grains are characterized by their aspect ratio (R), which is the ratio of the mean equivalent circular diameter (ECD) to the mean thickness of the grains (e).

In the scope of the invention, the tabular grain emulsion is an emulsion in which at least 50%, and preferably at least 80% of the grains are tabular grains of aspect ratio greater than or equal to 2, preferably in the range 5 to 20.

Such emulsions are, for example, described in *Research Disclosure* September 1996, 591, Section I (referred to hereafter as *Research Disclosure*).

Useful emulsions in the scope of this invention preferably contain silver halide grains made up essentially of silver bromide, i.e., the main silver halide in the grains is silver bromide. The silver halide grains that can be used in the scope of the invention can additionally contain silver iodide or silver chloride. In one embodiment, the grains in the emulsion of the radiographic product of the invention contain at least 90% (mol) silver bromide. These grains can additionally contain a quantity of silver chloride or iodide less than or equal to 10% (mol).

In a preferred embodiment, the silver halide grains in the emulsions for industrial radiography are silver bromo-iodide grains containing a quantity of iodide less than 3% iodide, the iodide being either localized in a part of the silver halide grain volume or spread evenly throughout that volume.

The emulsions in the radiographic product of the present invention comprise silver halide grains dispersed in a binder, conventionally a water-permeable hydrophilic colloid such as gelatin, gelatin derivatives, albumin, a polyvinyl alcohol, vinyl polymers, etc.

These silver halide emulsions can contain dopants such as rhodium, indium, osmium or iridium ions etc. (see Section I-D3 of *Research Disclosure*) generally in small amounts. These dopants are generally incorporated during the making of the emulsion.

The silver halide emulsions can be chemically sensitized using the methods described in section IV of *Research Disclosure*. The chemical sensitizers generally used are compounds of sulfur and(or) selenium and(or) gold.

The silver halide emulsions can also contain, among other substances, optical brighteners, antifoggants, surfactants, plastifiers, lubricants, hardening agents, stabilizers, and absorption and(or) diffusion agents such as those described in Sections II-B, VI, VII, VIII, and IX of *Research Disclosure*.

The radiographic product of the invention can comprise, in addition to the silver halide emulsion layer, other layers conventionally used in radiographic products such as protective layers (overlayer), interlayers, filter layers or antihalo layers. The support can be any suitable support used for products for industrial radiography. The conventional supports are polymer supports such as ethylene.

The overlayer can comprise antistatic agents, polymers, matting agents, etc.

Preferably, the products for industrial radiography of the invention comprise a support coated on both sides with a silver halide emulsion; the emulsions on the two sides of the support can be identical, or different in size, composition, silver content, etc.

The radiographic products in the invention can be hardened using hardening agents such as those described in *Research Disclosure*, Section II.B. These hardening agents can be organic or inorganic hardening agents such as chromium salts, aldehydes, N-methylol compounds, dioxane derivatives, compounds containing active vinyl groups, compounds containing active halogens, etc.

The radiographic products in this invention can be used in a radiographic system made up of 2 screens to intensify the ionizing radiation, placed on each side of the radiographic product.

These intensifying screens are screens that increase the proportion of ionizing radiation absorbed by the silver halide grains. The ionizing radiation interacts with the intensifying screen to release electrons in all directions. Some of these electrons are absorbed by the silver halide grains in the emulsion layer to form latent image sites. By increasing the number of electrons emitted in the direction of the grains, the number of electrons absorbed by the grains is increased. These screens are generally metal screens.

The screens commonly used comprise sheets of lead, lead oxide, or dense metals such as copper and steel. The thickness of these screens ranges from 0.025 mm to 0.5 mm, and depends on the type of ionizing radiation used.

The radiographic image is obtained by exposing the radiographic product to ionizing radiation either directly or through an intensifying screen.

The processing methods for industrial radiography comprise a black-and-white developing bath containing a developer and a fixing bath containing a silver halide solubilizer such as thiosulfate, thiocyanate, or sulfur-containing organic compounds. The conventional developers are generally dihydroxybenzene, 3-pyrazolidone or aminophenol compounds. A developer based on ascorbic acid or a derivative of ascorbic acid can also be used.

This invention is illustrated by the following examples that show the advantages of the invention.

EXAMPLES

Example 1

In this example, the radiographic products used consisted of an ESTAR® support coated on both sides with a layer of silver halide emulsion comprising tabular grains with a silver content of 75 mg/dm$^2$/side (total silver content 150 mg/dm$^2$).

The emulsion contained tabular grains AgBrI (I: 0.6 mole %), ECD=0.96 $\mu$m, e=0.10 $\mu$m. Each layer of silver halide emulsion was coated with a protective layer of gelatin containing a matting agent.

The product was hardened with a quantity of bis (vinylsulfonylmethyl)ether equal to 3% by weight of the total dry gelatin contained in the product.

The tabular grains accounted for more than 90% of the total number of grains in the emulsion.

The emulsion was prepared by double-jet precipitation. It was then sensibilized with sulfur and gold. After addition of chemical sensitizers, the emulsion was kept for 15 min. at 65° C. When compound (I) was present, it was added at 40° C. after the chemical sensitization and temperature plateau steps, in the quantities indicated below.

Each radiographic product was placed between 2 lead screens (25 $\mu$m) with an 8 mm copper filtration, and then exposed to radiation of energy 220 keV.

After exposure, each product was developed with a Kodak MX800® process for industrial radiography (8 min., 26° C., dry-on-dry), which comprised a hardening-developing step using a hydroquinone-phenidone developer (2 min.), a fixing step (2.5 min.), a washing step (2 min.) and a drying step.

For each sample, the speed of the film was measured by the exposure necessary to obtain a density equal to 2 above the density of the support and fog of the film.

Samples of exposed films were stored for 1 month at ambient temperature. After storage, the films were developed and the speed of the films was evaluated again.

The table below gives the difference in speed between the freshly exposed radiographic product and the exposed radiographic product after storage.

TABLE 1

| Compound (I) | Quantity (I) (mmol/mol Ag) | Initial speed | Difference in speed |
|---|---|---|---|
| — | — | 100 | −4 |
| A | 0.1 | 100 | −1 |
| C | 0.1 | 100 | −1 |
| E | 0.1 | 100 | −1 |

The speeds were calculated relative to a control film containing no compound (I), standardized to 100.

This example shows that when a radiographic product containing compound (I) was exposed to ionizing radiation, the keeping of the latent image was substantially improved.

Example 2

In this example the radiographic products of Example 1 were exposed to Co60 radiation (1.2 MeV) through a steel wedge. The product was developed in the conditions described in Example 1.

The density results given in table 2 were obtained by reading the developed exposed films with a transmission densitometer for a given area of the steel wedge.

TABLE 2

| Compound (I) | Quantity of (I) (mmol/mol Ag) | Density |
|---|---|---|
| — | — | 4.67 |
| C | 0.1 | 5.10 |
| E | 0.1 | 5.02 |
| A | 0.1 | 5.04 |

The results show that when a radiographic product contained compound (I), Co60 exposure gave the product a higher radiographic sensitivity.

The invention has been described in detail with particular reference to certain preferred embodiments thereof, but it will be understood that variations and modifications can be effected within the spirit and scope of the invention.

What is claimed is:

1. A method of formation of an industrial radiographic image comprising the steps of (i) exposing a non-spectrally sensitized industrial radiographic product containing at least 50 mg of silver/dm$^2$ to ionizing radiation of energy equal to at least 40 keV to form a latent image, said product comprising a support covered on at least one of its faces with a layer of radiation-sensitive silver halide emulsion in which at least 50% of the grain are tabular and at least 0.05 mmole/silver mole of a compound of formula (I)

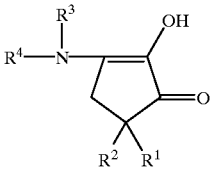

wherein $R^1$ and $R^2$ are each independently an atom of hydrogen, an alkyl group comprising from 1 to 5 atoms of carbon, substituted or not, a hydroxyl group, or a benzyl group; $R^3$ and $R^4$ are each independently a hydrogen, or an alkyl group from 1 to 5 atoms of carbon, or jointly comprise the atoms necessary to form a heterocycle of 4 to 6 atoms, substituted or not, and (ii) developing the exposed product to form a radiographic silver image.

2. The method of claim 1 wherein $R^1$ is selected from a hydrogen atom or a hydroxyl group and $R^2$ is a methyl group.

3. The method of claim 1 wherein the silver halide emulsion is a tabular grain emulsion made up mostly of silver bromide.

4. The method of claim 1 wherein compound (I) is present in quantities in the range from 0.1 to 0.5 mmole/silver mole.

5. The method of claim 1 wherein the radiographic product comprises a support coated on both sides with a layer of silver halide emulsion.

6. The method of claim 5 wherein two screens to intensify the ionizing radiation are placed on each side of the radiographic product.

* * * * *